US005203846A

United States Patent [19]

Kuhns et al.

[11] Patent Number: 5,203,846

[45] Date of Patent: Apr. 20, 1993

[54] MEDIA FEED ROLL APPARATUS AND METHOD FOR ITS USE

[75] Inventors: Richard J. Kuhns; Neil A. Polit, both of Crystal Lake, Ill.

[73] Assignee: A. B. Dick Company, Chicago, Ill.

[21] Appl. No.: 791,036

[22] Filed: Nov. 12, 1991

[51] Int. Cl.[5] ..... B65H 3/52

[52] U.S. Cl. ..... 271/125; 271/274

[58] Field of Search ..... 271/10, 117, 124, 125, 271/137, 138, 273, 274

[56] References Cited

U.S. PATENT DOCUMENTS

| | | | |
|---|---|---|---|
| 2,635,874 | 4/1953 | La Bore | 271/125 |
| 3,933,350 | 1/1976 | Mignano | 271/125 |
| 4,050,690 | 9/1977 | Michelson | 271/125 |
| 4,324,396 | 4/1982 | Albright et al. | 271/125 |
| 4,522,520 | 6/1985 | Takenoya et al. | 271/274 |
| 4,961,566 | 10/1990 | Labombarde | 271/124 |
| 5,011,129 | 4/1991 | Holbrook | 271/274 |

*Primary Examiner*—Robert P. Olszewski

*Assistant Examiner*—Steven M. Reiss

*Attorney, Agent, or Firm*—Jones, Day, Reavis & Pogue

[57] ABSTRACT

A media feed roll apparatus is provided for the transfer of articles such as envelopes, magazines and newspapers, one by one, from a stack to a transport which conveys these articles to a work station for printing or labeling. The apparatus and methodology according to the invention allow for independent adjustment of the roller nip between upper drive rollers and lower facing rollers so that an article such as an envelope can be inserted into the nip with the roller pairs providing substantially equal nip pressure on the article. Roller nip pressure is achieved through a mechanism allowing raising and lowering of the upper drive rollers, preferably by a pivotal action, which are independently suspended. Upon being released from the mechanism, the rollers are biased toward the article thereby creating substantially equal nip pressure on the article even if the nip spacing is different as a result of the article having different thicknesses.

23 Claims, 6 Drawing Sheets

MEDIA FEED ROLL APPARATUS AND METHOD FOR ITS USE

FIELD OF THE INVENTION

The present invention relates to an apparatus for transferring articles having relatively broad surfaces relative to thickness such as envelopes, one by one from a stack to a transport which conveys the articles to a printing or labeling work station. In another aspect the invention relates to a feed roll apparatus for advancing the articles from the underside of a stack, one at a time, onto a transfer means that carries the articles to a work station. In yet another aspect, the invention relates to an apparatus and method for positioning, i.e., spacing upper drive rollers and lower facing rollers so that an article such as an envelope can be inserted into a nip between the rollers, utilizing a mechanism which allows raising and lowering of the upper drive rollers by toggle lever means to achieve equalized pressure application to the article by the rollers as the article is inserted into the nip and to avoid skewing of the article as it passes through the nip.

BACKGROUND OF THE INVENTION

The invention relates to various labeling machines and printing machines of the general type which include article feed rolls. The feed roll apparatus is particularly useful with respect to automatic article labeling or printing machines. There are a large number of machines in which a plurality of articles such as envelopes are processed (e.g., envelopes being supplied in a stack and requiring correct feeding, one by one) in a line position for printing or labeling. Many machines utilizing automatic feed arrangements do not permit continuous loading while the machine is in operation and/or cannot accommodate various sized or shaped articles.

Labeling and printing machines capable of automatically handling individual articles such as envelopes, magazines, newspapers and the like are available which can handle these various shaped and sized articles without changing the structural configuration of the machines. However, in order to accommodate the variety of shapes and sizes, the machine must be structured to enable resetting of the components of the machines, particularly the feed apparatus. That is, the machine must be structured to allow adjustment of the spacing between the feed rollers from a thickness of two or three sheets of paper to magazine or newspaper thicknesses. In these circumstances, the roller feed apparatus and printing apparatus is raised or lowered in accordance with the material being processed.

Prior art machines have normally utilized mechanical, threaded drive means for adjusting the raising and lowering of the rollers resulting in a quite tedious and time consuming mechanism. In these prior machines, various worm wheels and worm in shaft systems are married in order to allow for hand knob manual adjustment wheels. The rotation of these adjustment shafts, worms and gears move the moveable portion of otherwise stationary feed rollers and printing heads upwardly and downwardly depending on the articles being printed or labeled. Major adjustments in some prior machines are made by manual nuts which raise and lower a portion of the working roller in order to accommodate various thicknesses of material which are intended to be processed in the apparatus.

Thus, the article feed mechanisms employed in known methods and machines provide adjustment capabilities to the operator for adjusting the separation of the upper and lower feed rollers, i.e., adjustment of the roller nip. Usually, this adjustment is made by a threaded mechanism which must be adjusted by turning the knob multiple rounds in order to enlarge the nip to receive thicker documents or articles. The feed rollers are in a vertical relationship and when two or more roller nips are created through multiple roller pairs, equal nip pressure on the articles is achieved only by trial and error manipulations by the operator of individual threaded adjustment means. Whether or not the operator creates equal pressure for contact with the media being processed depends on adjustment of one roller nip at a time followed by an assessment as to whether the pressure is the same with each roller. Such adjustments are very tedious and time consuming.

In one known system, a single adjustment knob is utilized for achieving total height adjustment for the articles to be processed. This single height adjustment is also used for fine tuning. Other systems allow for one set of rollers (either bottom or upper rollers) to be cam shaped in order to provide clearance for variable thickness articles and to achieve a gripping action without hopping. However, such apparatus still presents complexities of adjustment. For example, in one such product, upper feed rollers are cammed up and down by a lifter mechanism but each roller must be tediously set individually to finely adjust the rollers to exert identical pressure against the media. The same adjustment knob also controls the roller height for changes in media thickness. In another apparatus, the lower feed rollers are cammed up and down and are tied together with the upper rollers but must again be adjusted by a knob mechanism for media thickness. In all of these prior art feed roller mechanisms adjustments of height or roller nip is accomplished by tedious twist knob, screw adjustments.

BRIEF DESCRIPTION OF THE INVENTION

The media feed roll apparatus in accordance with the invention is utilized for advancing articles such as envelopes, magazines, newspapers and the like from the underside of a stack, one at a time, onto a transport means that carries the articles to a work station either for printing, or labeling, or both. At least one pair of feed rollers including an upper driven roller and a rotatably mounted facing fixed lower roller which may be driven or not, as desired, are presented with the position of the rollers being advantageously selected by utilizing the apparatus of the invention. For example, a stack of articles such as envelopes are presented next to a vertically moveable gate in front of the pair of feed rollers whereby the envelopes are fed one by one into the nip between the upper driven rollers and the facing lower rollers which may also be driven or not, as desired. The upper driven rollers contact the envelope and advance the envelope onto a transport means for moving the individual envelopes to a work station.

It is most important to set the spacing between, for example, an upper roller pair and a lower facing roller pair so that an article can be inserted into the nip, while assuring the upper roller pair still engages the envelope and applies sufficient pressure to provide a frictional driving force to advance the envelope to the transport means without being skewed. Facilitating these adjustments for proper pressure and spacing depending on the thickness of the articles to be processed has been accomplished in the past by individual adjustment of each roller pair through tedious screw adjustments. However, the present invention utilizes an improved lift assembly, preferably a pivotted assembly, wherein the upper drive rollers are independently spaced relative to facing, fixed lower rollers by mere adjustment of a single clamp. Each roller of the upper roller pair is moveably carried in a frame which includes a trunnion individually associated with each roller, the trunnion being connected to a carriage. Each trunnion is threadably engaged with one end of a shaft having an adjustment knob affixed to an opposite end thereof so that operation of the knob accomplishes fine tuning of the roller position, if required, via relative movement of the trunnion.

In accordance with this invention, gross adjustment of the position of the upper roller pair relative to the lower roller pair is accomplished via a toggle mechanism. Preferably, the toggle mechanism is operated by a pivot lift arm which lifts the upper drive roller pair via the toggle mechanism. The upper drive roller pair is driven by one power source shaft and the upper rollers are independently driven by belt timing means. The pivot lift assembly lifts the upper roller pair relative to a stationary frame base which pivotably supports the toggle mechanism. Movement of the pivot lift arm causes the toggle mechanism to raise the trunnion and carriage assembly of each of the upper roller pair through a link means to separate the upper roller pair from the facing lower roller pair. Downward biasing springs bias each of the upper roller pair downwardly and are interposed between the trunnion and the base.

Another aspect of the invention is that the upper drive roller assembly can be clamped in position after being pivotally shifted to contact the various thicknesses of the articles being processed. The upper drive roller pair can in some circumstance require different elevations in relationship to the fixed lower facing roller pair. The upper rollers are released by loosening of clamp means allowing the upper rollers to seek an immediate operational level, i.e., contact with the article because of the force of the biasing springs. At that position, the clamp means are reactivated to hold the pivot lift assembly and upper drive rollers in place. As previously noted, the position of each individual upper roller can be separately fine tuned, if required, with each upper roller being adjusted through operation of the adjustment knob and the trunnion and carriage means associated with each of the upper rollers. Drive is supplied to the upper roller pair through a shaft which rotates a drive pulley for each upper roller through individual timing belts and drive pulleys which are fixed to the individual rollers.

The pivot lift assembly provides a common lift wherein the upper drive rollers are raised and then released. These drive roller assemblies are under the force of a biasing spring so that each roller independently positions on the articles. The roller assemblies are readily clamped into these independent positions by clamping means. The pivot lift assembly allows for the drive means to be shared by the two upper rollers through the pivot point.

BRIEF DESCRIPTION OF THE DRAWINGS

The invention is herein described by way of example, only with reference to a preferred embodiment illustrated in the accompanying drawings, wherein.

DETAILED DESCRIPTION OF THE INVENTION

Figure 1:
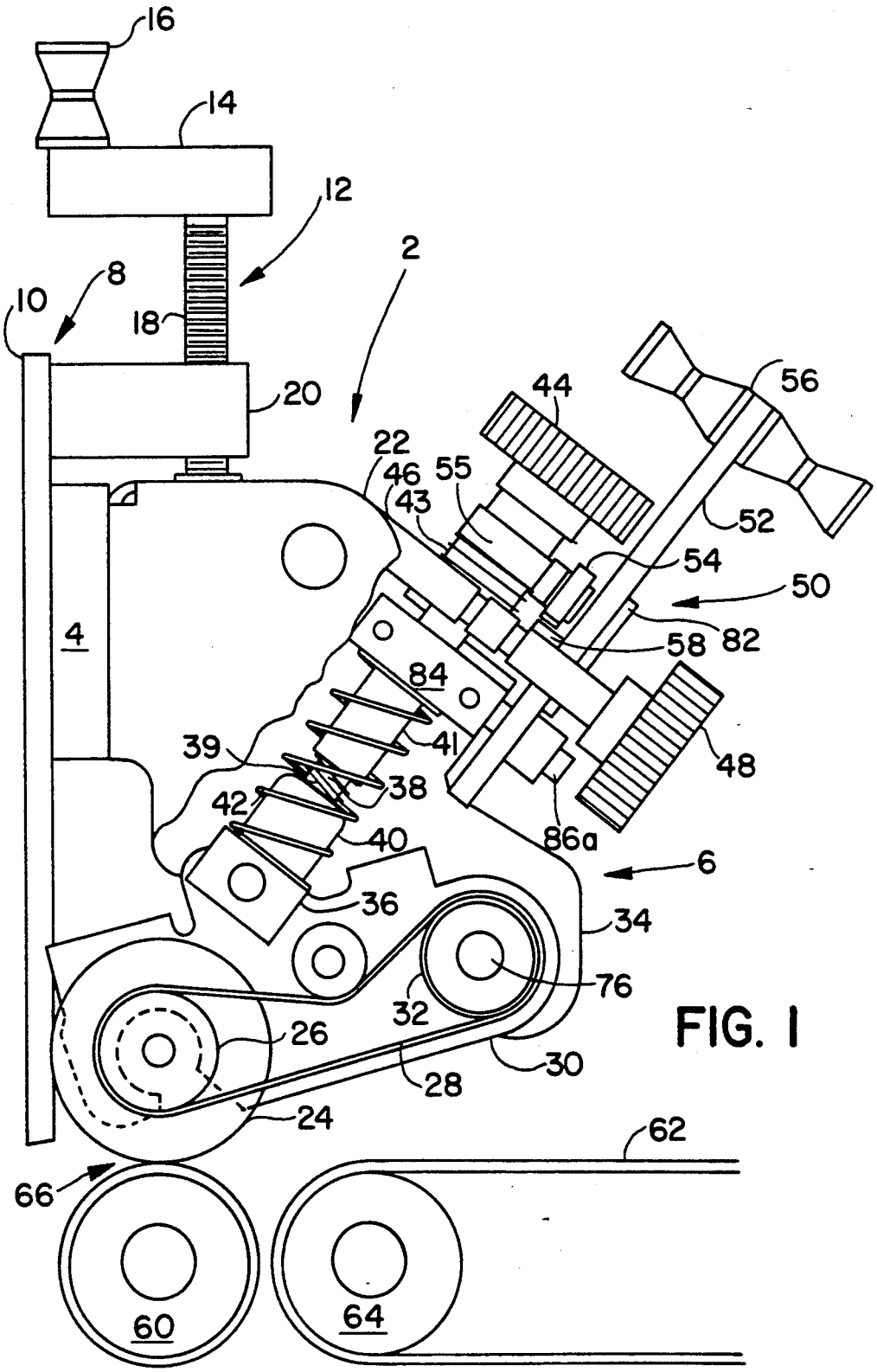
FIG. 1 is fragmentary side view of the media feed roll apparatus showing one of two independent drive roller assemblies, pivot lift assembly and gating assembly with the upper drive roller in a lowered operational position defining a feed nip for feed articles.

Referring to FIG. 1, a fragmentary side view of a media feed roll mechanism 2 in accordance with the invention is shown with an upper drive roller assembly 6 mounted on a support member 4. The upper drive roller assembly 6 is shown with associated gating assembly 8 with gate 10 having a vertical height adjustment assembly 12. A gate adjustment lever 14 and handle 16 provide drive adjustment means through shaft 18 which is attached to gate arm 20 thus providing means for raising and lowering the gate 10 in relationship to the drive roller assembly frame 22 and support member 4. Upper drive roller 24 is shown in FIG. 1 as exemplary of the upper drive rollers employed herein. However, it is to be noted that two upper drive rollers are utilized in the depicted device which are mounted independently, in tandem with the second upper drive roller being positioned immediately behind the fragmented side view upper drive roller of FIG. 1. The upper drive roller 24 has a pulley 26 which is in communication with a drive and timing belt 28. The upper drive roller 24 is driven through the belt 28 and pulley 26 wherein the belt receives its driven motion through drive pulley 32. The upper drive roller assembly 6 is carried in carriage 0 which is pivotally mounted in relationship to the stationary base section 34 of drive roller assembly frame 22.

The upper drive roller assembly 6 includes a trunnion 36 which is in communication with an upper roller positioning shaft 38. The upper roller positioning shaft 38 is threadably received at its lower end by trunnion thread receiving element 40, the shaft 38 having threads in communication with the trunnion thread receiving element 40 for fine tuning, i.e., lowering or raising the upper drive roller 24 via adjustment of fine tuning knob 44 which is affixed to the upper end of shaft 38. If necessary, this fine tuning effect may be accomplished either during idle or during operational conditions of the mechanisms.

A compression spring 39 is retained between the bottom of a lifting tube 41 surrounding the shaft 38 and the trunnion 36. This compression spring 39 is provided to add additional drag load to secure adjustment knob 44 against vibration in operation of the device of the assembly 50. Such vibration is primarily a result of the "hopping" action which may be employed in the operation of mechanism 2 for purposes of accommodating different type media being fed simultaneously through the device. This hopping action may be disarmed if desired by the operator.

A biasing spring 42 is maintained between the trunnion 36 and frame member 84 of pivot lift assembly 50 for biasing the upper drive roller assembly 6 in a downward direction. Another biasing spring 43 is positioned between clamping bracket 4 and collar 55 which is formed as an integral part of tube 41. The clamping bracket 46 is interconnected with the lifting tube 41 and limits the downward movement of the upper drive roller 24 by contact with frame 84. The shaft 38 has a fine tuning knob 44 for final positioning of the upper drive roller 24 through trunnion 36.

The pivot lift assembly 50 has a pivot lift lever 52 interconnected with a toggle arm 81 (best illustrated in FIGS. 6 and 7) which accommodates a cam follower 58 mounted on a pivot 88 which is interconnected with link plate 82. Link arm 54 which is pivotally connected to collar 55 rides on cam follower 58 for purposes of raising and lowering the upper drive roller 24. A feed nip 66 (shown in FIGS. 1 and 3) for receiving articles is formed between the upper drive roller 24 and lower facing roller 60. Articles received in nip 66 are moved by the upper drive roller and lower facing roller 60, one by one onto a transport belt 62 positioned around belt roller 64 which is proximate to the lower facing roller 60.

Figure 2:
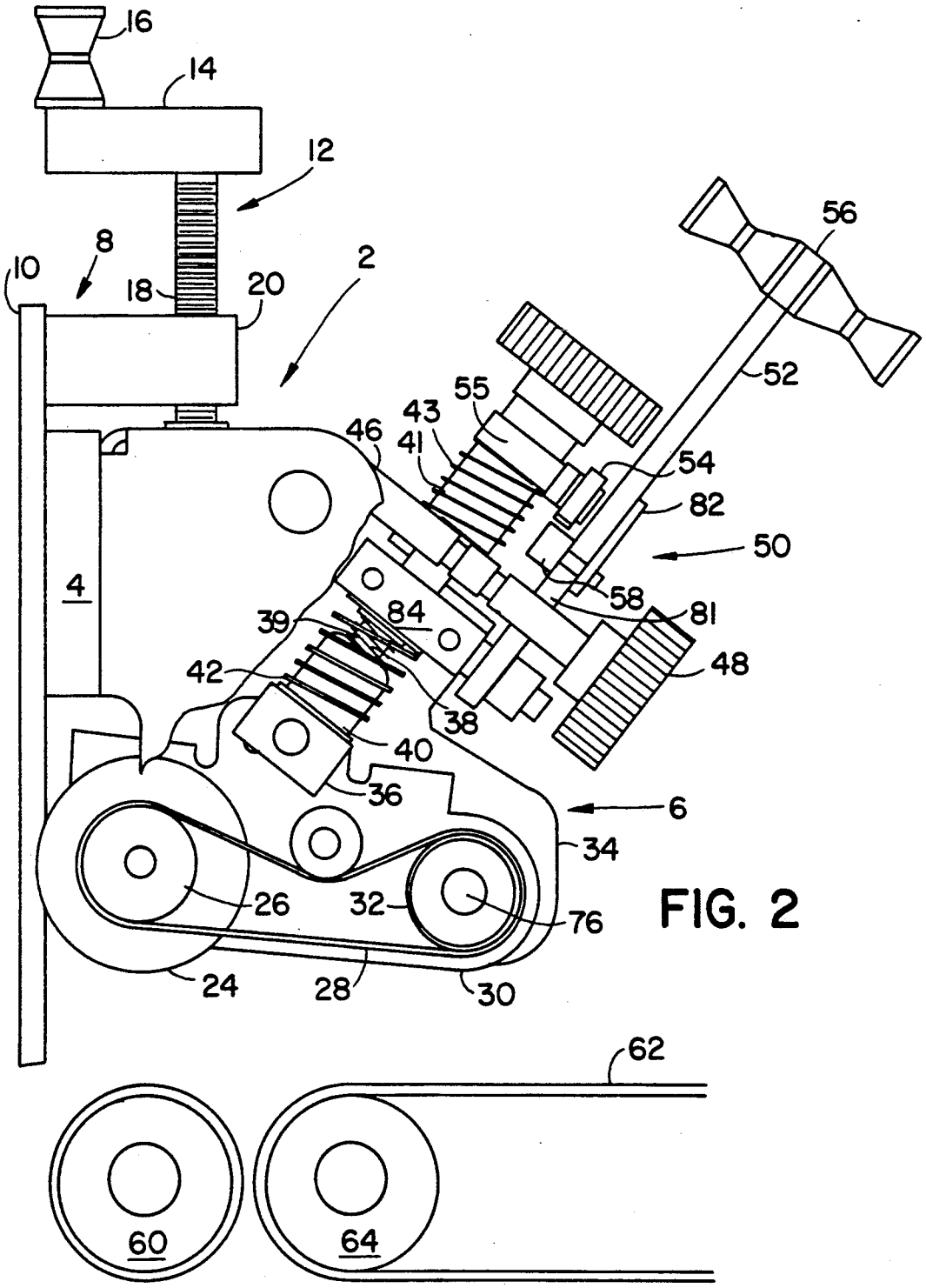
FIG. 2 is a fragmentary side view of the media feed roll apparatus showing one of two independent drive roller assemblies, pivot lift assembly and gating assembly with the upper drive roller in a raised, non-operational position or a pivoted position prior to adjustment of the drive roller.

FIG. 2 presents a fragmentary side view of the media feed roll apparatus moved via operation of the pivot lift assembly 50 into a raised position relative to the position of the fixed lower facing roller 60. The positions of the elements comprising pivot lift assembly 50 including lift lever 52, lever handle 56, toggle arm 81, cam follower 58 and link arm 54 are all shown in different relationships to, for example, fine tuning knob 44 and lifting tube 41 than are shown in FIG. 1.

Figure 3:
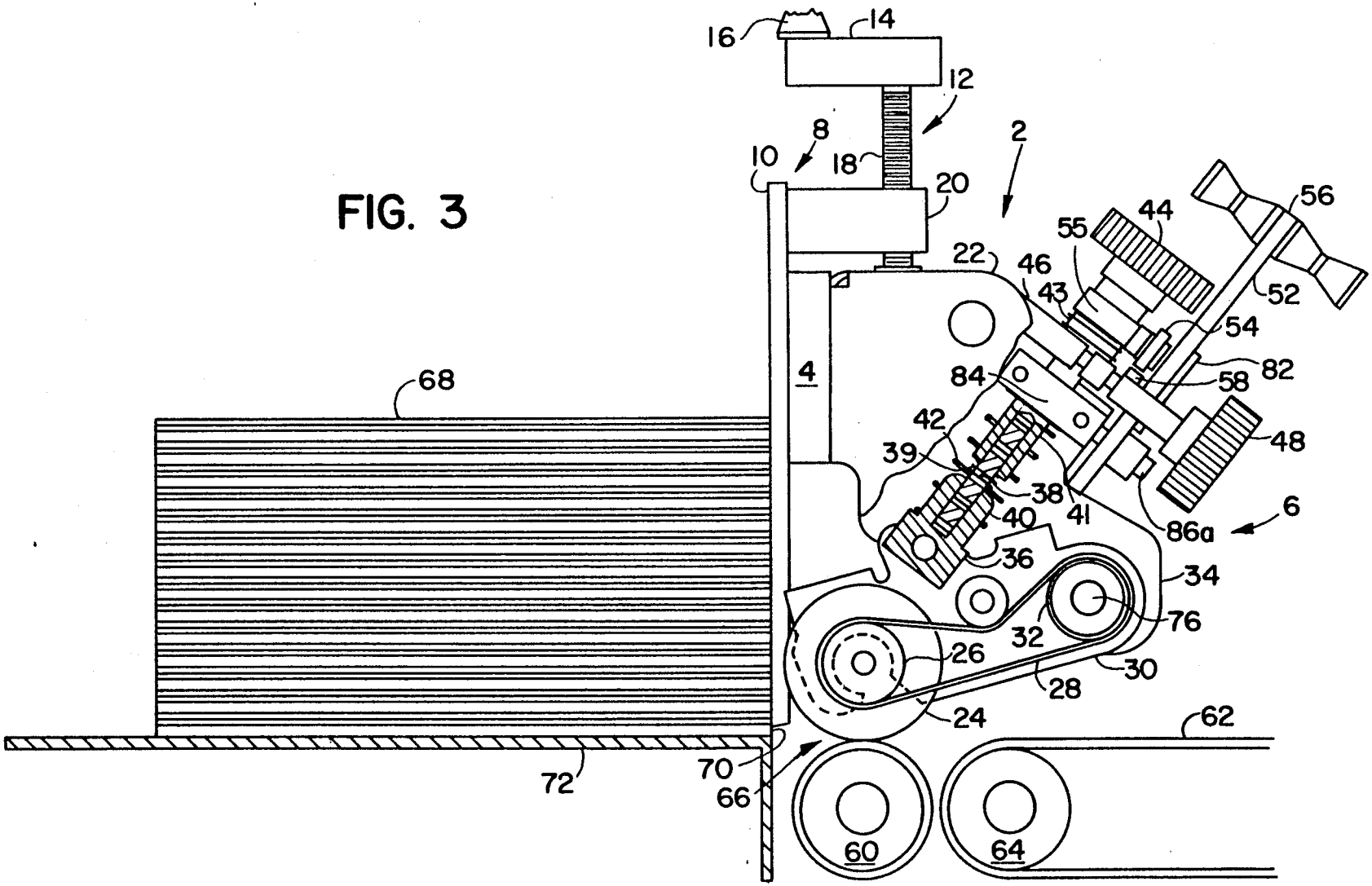
FIG. 3 is a fragmentary side view of the media feed roll apparatus in operational position as shown in FIG. 1 in combination with a feed hopper inclusive of stacked articles.

FIG. 3 presents a fragmentary side view of the media feed roll apparatus in operational position as shown in FIG. 1 in combination with an article stack 68, article feed shuttle 72 and gate opening 70. As shown in FIG. 3, the invention is used to transfer items such as envelopes one by one from article stack 68 to a transport means 62 such as a vacuum belt which transports the individual articles to a work station (not shown). The work station can include a printing station, labeling station and the like. The transfer from the stack to the transport means requires a shuttle mechanism and a feed roller mechanism for advancing the articles from the underside of stack 68 one at a time onto the transport belt 62. This feed roll apparatus is critical to the uniform advancement one at a time of the articles to be further processed. The timing and alignment position of the flow of articles through the media feed roll apparatus is critical to the functionality of the printing or labeling work station.

Figure 4:
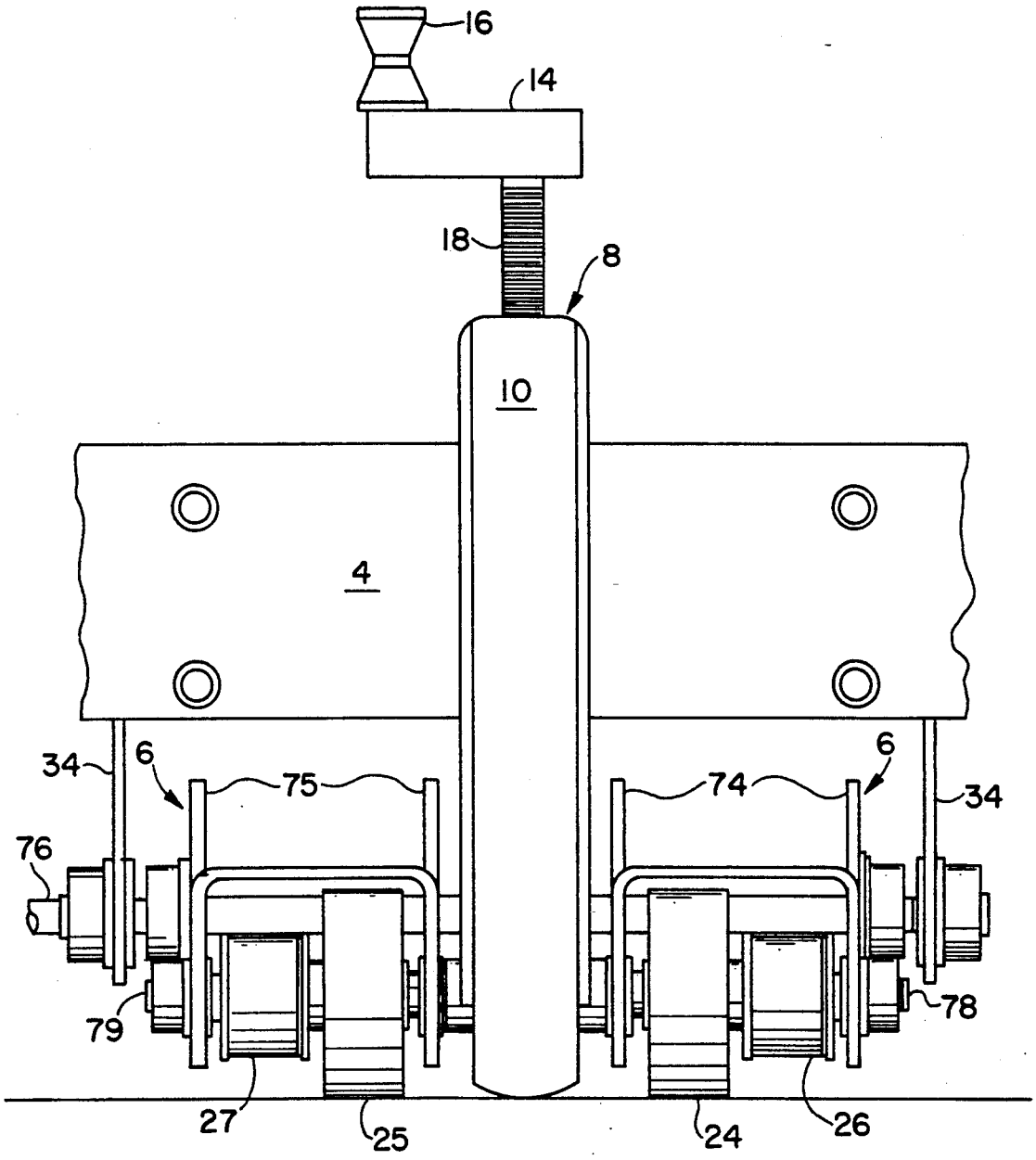
FIG. 4 is a fragmentary front view or feed side view showing the two independently suspended upper drive roller assemblies in a lowered operational position.

In FIG. 4, a fragmentary front view or feed side view shows two independently suspended upper drive roller assemblies corresponding to the assemblies 6 illustrated in FIGS. 1-3 are shown in a lowered operational position. Non-continuous lift arms 74 and 75, which are depicted in fragmentary views are connected to these upper drive roller assemblies and are subject to movement through the pivot lift assembly 50. As can be seen from FIG. 4, the lift arm elements 74 and 75 provide independent suspension for the upper drive roller assemblies including upper drive roller 24 and 25 as well as drive roller pulleys 26 and 27. Accordingly, the upper drive rollers 24 and 25 can be readily adjusted at different heights to accommodate differing thicknesses of the articles being transported therethrough.

Figure 5:
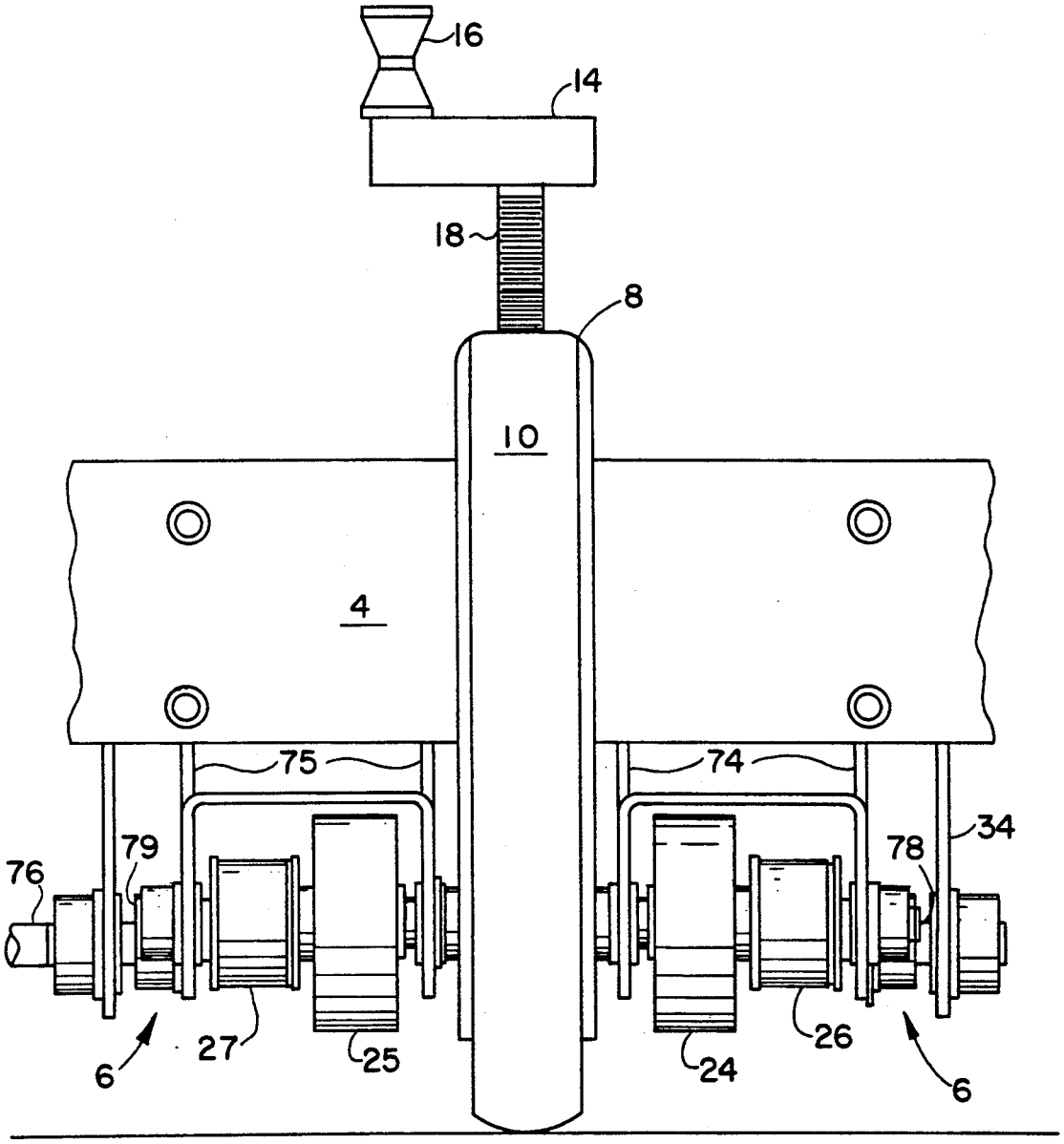
FIG. 5 is a fragmentary front view or feed side view showing the two independently suspended upper drive roller assemblies in a raised position.

A drive shaft 76 which is shown in fragmentary section provides drive motion to the drive pulleys 26 and 27 which are on the respective drive roller axles 78 and 79. The drive shaft 76 is connected to an external drive shaft (not shown). The drive shaft 76 acts as a pivot point which allows for pivotal raising of the upper drive roller assembly as can be seen in FIG. 5. The relative position of the drive shaft 76 is unchanged while upper drive rollers 24 and 25 share a common raised axis position.

Figure 6:
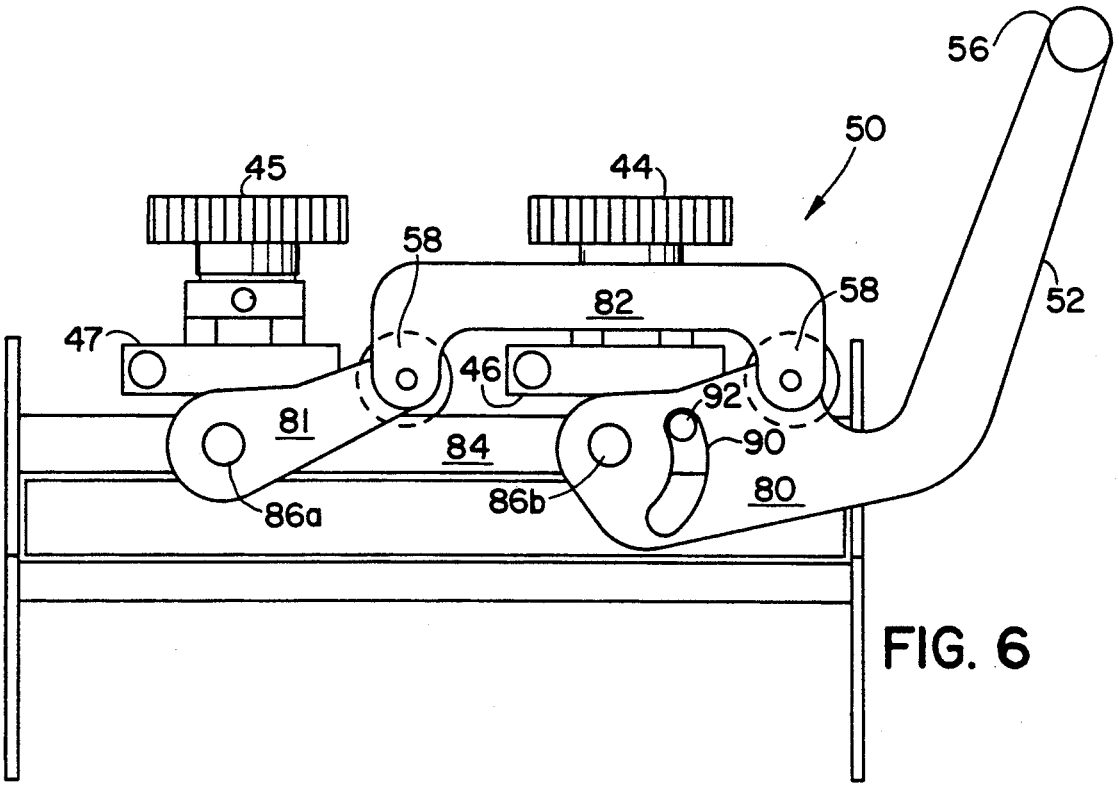
FIG. 6 is a side view in enlarged isolation of the pivot lift assembly linkage with the linkage positioned for placing the upper drive roller assemblies in a lowered operational position.
Figure 7:
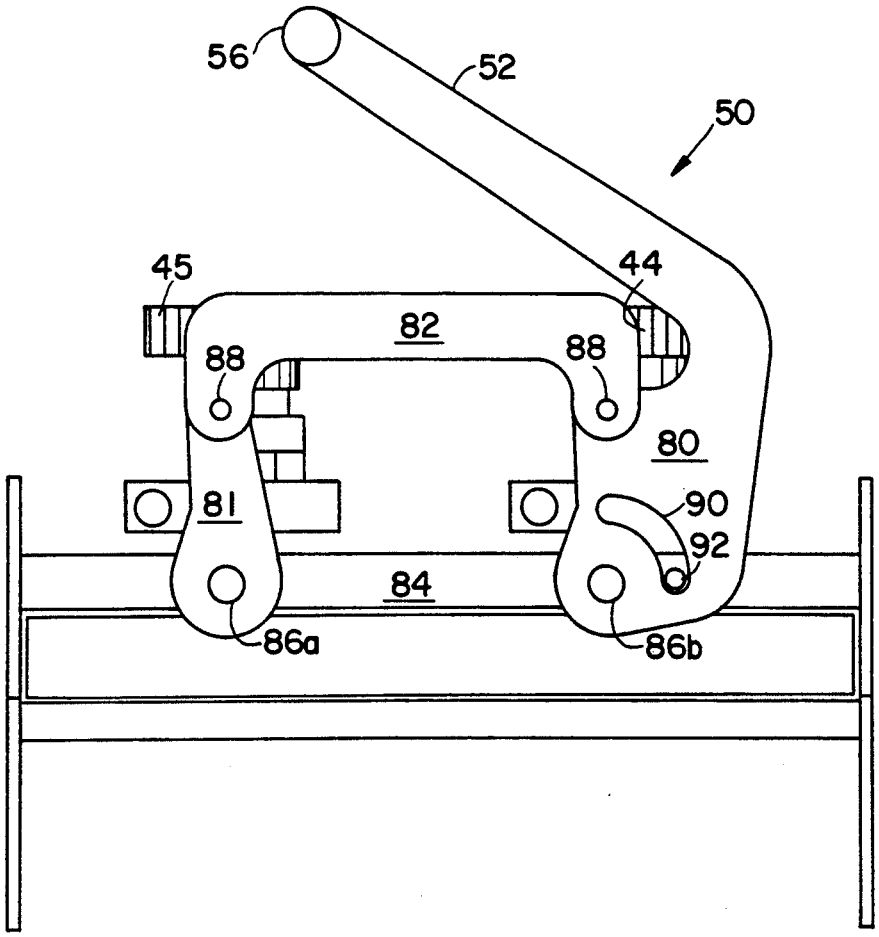
FIG. 7 is a side view of the pivot lift assembly linkage in enlarged isolation in a raised position which correspondingly would raise the upper drive roller assembly to a non-operational, pre-adjustment position.

In FIGS. 6 and 7 enlarged isolation sideviews are provided of the pivot lift assembly linkage with linkage positions illustrated for positioning the upper drive roller assemblies in a lower operational position in FIG. 6 and in a raised position in FIG. 7. In both FIGS. 6 and 7 toggle arms 80 and 81 are connected by a toggle arm connector 82. The toggle arms 80 and 81 are rotatably connected to the toggle arm connector 82 and rotatably connected to frame member 84 through frame pivot shafts **86*a* and 86*b*, respectively. The toggle arm 80 through extension provides a pivot lift lever 52 terminating in a lift lever handle 56. Movement of toggle arm 80, pivot lift lever 52 and pivot lift lever handle 56 is limited by lift assembly travel guide 90 in cooperation with frame affixed pin 92**.

The media feed roll mechanism 2 in accordance with the invention can accommodate articles having a thickness of up to one inch or more. Due to the variation of materials which require printing and labeling such as letters, newspapers, magazines and the like, such clearance and adaptability of the media feed roll mechanism 2 is most desirable. Adjustability of such mechanism permits quick release, independent suspension of the upper drive rollers insures controlled one by one aligned feeding of the stacked articles from the gating assembly through to the transport means and work stations without skewing. The gating assembly and the upper drive roller assembly are used in combination to control the feeding of articles having various sizes and thicknesses inclusive of magazines, newspapers and single sheets and envelopes. The apparatus according to the invention can accommodate articles having dimensions of 17 inches by 17 inches or larger and as small an article as 3 inches by 5 inches or smaller.

In operation, the media feed roll mechanism 2 cooperates with the feed shuttle means 72 moving the bottom article to entry of the roller assembly feed nip 66 between the upper drive roller and the lower roller which pulls the article away from the stack 68 through drive roller contact and onto a transport means.

The apparatus according to the invention provides a mechanism in which the upper drive rollers 24 and 25 are raised by the movement of a single lever 52. The rollers 24 and 25 may be raised either after unclamping the upper drive roller assembly 6 by release of clamps 46 and 47 or while the upper drive roller assembly 6 remains in a clamped condition via clamps 46 and 47, as desired. Then, the article is inserted between the upper and lower drive rollers with the upper roller in its raised position and then the upper drive roller is lowered onto the article by manipulation of lever 52 in order to position the roller on the article as it passes through the nip 66.

Adjustment of the upper drive rollers 24 and 25 is achieved by the biasing spring 42 acting to force the independently suspended rollers 24 and 25 into contact with an article which is in place under the rollers. Once the upper drive rollers are in position on the article with equal pressure being applied to the article by each of the rollers, then the rollers are clamped or locked in such position by engaging the clamping means 46 and 47.

However, if the rollers have not been previously unclamped as, for example, during the raising of the rollers, then it is necessary for proper adjustment to unclamp clamps 46 and 47 to allow the rollers 24 and 25 to settle onto the surface of the article being fed through the apparatus under the influence of biasing springs 42 of assemblies 6. Then, after the rollers 24 and 25 are properly positioned on the article in a manner such that each of the rollers provides equalized pressure thereon, the clamps 46 and 47 are reclamped to maintain the rollers 24 and 25 in such position as the article is transported through the nip without skewing. Furthermore, it should be noted that in operation of the present apparatus if it is desired to readjust the setting of rollers 24 and 25 from a previous setting accommodating thin articles to one in which thick articles are to be fed by raising the rollers 24 and 25 off the initial "thin" setting and allowing the rollers to settle back onto a thick article setting and then releasing or unclamping clamps 46 and 47, springs 43 in assemblies 6 will cause the clamps 46 and 47 to relocate to their appropriate new positions before being clamped.

When it is desired to utilize the apparatus according to the invention for articles with stepped thickness, the apparatus is again raised through one lever action, i.e., the pivot assembly 50 appropriately released by proper action of clamp 46 to allow the independent rollers 24 and 25 to seek their independent levels providing optimal pressure to avoid skewing of the articles fed through the apparatus. Each upper drive roller 24 and 25 is then individually clamped into place. If independent suspension of the upper drive rollers was not available in accordance with the invention, the rollers could produce skewed travel of the articles. For example, when an article having various thicknesses at different locations is being processed, such as an envelope containing credit cards on one side or other items of promotion, in the absence of independent suspension of each of the rollers in the roller assembly, proper alignment of the rollers with the article being fed may be prevented as a result of the formation of a gap or space between one or more of the rollers and the article. This would result in the application of differential pressure to the fed article at the different locations and would increase the probability of the occurrence of skewing.

Furthermore, in the devices of the present invention, other article irregularities can be adjusted for by fine tuning of the apparatus. Essentially, the upper roller positioning shaft 38 is comprised of a rod within a tube. A 5/16 inch shaft that is fixed to the fine tuning knob 44 provides fine tuning, i.e., fine adjustment up and down of the upper drive roller. Known systems utilize similar adjustment, i.e., screw adjustment, that generally uses larger spaced threading to more quickly move the adjustment per turn. However, with the advantage of the pivot lift assembly 50 according to the present invention, the operator is allowed to use finer thread adjustment. For example, 24 threads on a 5/16 shaft provides 24 rotations to go through an inch versus a quicker adjustment, for example, 12 threads or 12 rotations per inch. Prior to the present invention, the operator was forced to adjust the roller down to the article by thread adjustment and to raise the roller by reverse thread rotation with the same thread design used for positioning and adjustment. Operator error requiring re-adjustment was a common occurrence.

The media feed roll apparatus in accordance with the invention provides through a single lever means capability of moving two or more independently suspended upper drive feed rollers to a raised position and to lower these upper feed rollers onto the surface of an article to be fed through the apparatus in a manner such that the upper feed rollers will be independently supported on the surface of the article with a proper pressure balance between the rollers. Such a procedure allows the setting of the rollers on the article after which the rollers are maintained in such position by securing clamp means. This balancing of pressure and position setting is accomplished through straight forward, simple engineering that will enable the operator to achieve desired results with a minimum of effort and yet with a high degree of precision.

While the invention has been described and illustrated in connection with preferred embodiments, many variations and modifications as will be evident to those skilled in the art may be made therein without departing from the spirit of the invention, and the invention as set forth in the appended claim is thus not to be limited to the precise details of construction set forth above as such variations and modifications are intended to be included within the scope of the appended claims.

What is claimed is:

1. A media feed roll apparatus for advancing articles onto a transport means, comprising:

a drive roller assembly with at least one upper drive roller mounted on a frame for moveable engagement with a lift assembly, at least one lower roller mounted on said frame facing each said upper drive roller, said at least one upper roller and said at least one lower roller being rotatably mounted in proximity to a transport means, said at least one upper drive roller and said at least one lower roller forming an article feed nip therebetween for accommodating said article to be advanced onto said transport means; and the lift assembly including a first toggle arm connected to a lift lever, said first toggle arm being rotatably mounted for connection through a toggle arm connector to a second rotatably mounted toggle arm, the lift assembly being positioned relative to the at least one upper drive roller in a manner such that movement of said lift lever causes the at least one upper drive roller to move from a raised drive roller position to a lowered article engagement position to engage the article with an adjustable preset pressure, said drive roller assembly being releasably clampable at said raised or lowered position by a clamping means that is operable independent of the lift assembly to set separation of the upper and lower rollers to handle a range of article thicknesses.

2. A media feed roll apparatus according to claim 1 wherein said drive roller assembly is clamped to maintain said drive roller assembly in a lowered article engagement position.

3. A media feed roll apparatus according to claim 1 wherein two drive roller assemblies are raised and lowered by a single lift assembly, the two drive roller assemblies being independently suspended and are individually releasably clamped at raised and lowered positions by two separate clamping means.

4. A media feed roll apparatus according to claim 3 wherein said clamping means are comprised of a clamping bracket for fixing the upper drive roller position by interconnecting the clamping bracket to an upper drive roller lifting tube.

5. A media feed roll apparatus according to claim 4 wherein the upper drive roller lifting tube has a rotatably mounted internal shaft which is in threaded communication with a trunnion at a first end, said trunnion being positioned for engagement with said upper drive roller, said internal shaft having a fine tuning knob mounted at a second end for adjusting position of the upper drive roller.

6. A media feed roll apparatus according to claim 4 wherein a biasing spring surrounds the upper drive roller lifting tube, said biasing spring being mounted between the trunnion and a frame member of said lift assembly for biasing said upper drive roller in a downward direction.

7. A media feed roll apparatus according to claim 5 wherein the clamping means is biased by a spring mounted externally of the upper drive roller lifting tube between the clamping bracket and a collar formed integrally with said lifting tube.

8. A media feed roll apparatus for advancing articles having a relatively broad surface in relation to thickness one at a time onto a transport means, comprising:

a drive roller assembly with at least one upper drive roller mounted in a carriage, said carriage and drive roller assembly moveably attached to a frame, the frame mounted on a first support member, the carriage mounted to a pivot lift assembly, at least one lower roller facing each of said at least one upper drive roller, said at least one lower roller being rotatably mounted on a second support member and proximate to the transfer means, said at least one upper drive roller and said at least one lower roller forming an article feed nip; and the pivot lift assembly with a first toggle arm connected to a lift lever, said toggle arm being rotatably mounted on a frame member, said first toggle arm rotatably connected through a toggle arm connector to a second toggle arm rotatably mounted on said frame member, the pivot lift assembly connected to the carriage and upper drive roller, said pivot lift assembly, carriage and drive roller assembly moveable from a raised drive roller position to a lowered article engagement position to engage the article with a preset pressure, said drive roller assembly releasably clampable at a raised or lowered position by a clamping means that is operable independent of the lift assembly to set separation of the at least one upper and at least one lower roller to handle a range of article thicknesses.

9. A media feed roll apparatus according to claim 8 wherein said drive roller assembly is clamped in order to maintain said rollers in said lowered article engagement position.

10. A media feed roll apparatus according to claim 8 wherein the two drive roller assemblies raised and lowered by the pivot lift assembly are independently suspended and are individually releasably clamped at raised and lowered positions by two separate clamping means.

11. A media feed roll apparatus according to claim 10 wherein said clamping means are comprised of a clamping bracket for fixing the upper drive roller position by the clamping bracket being fixed to an upper drive roller lifting tube which is fixed to the carriage.

12. A media feed roll apparatus according to claim 11 wherein the upper drive roller lifting tube has a rotatably mounted internal shaft which is in threaded communication with a trunnion at a first end, said trunnion affixed to the upper drive roller assembly, said internal shaft having a fine tuning knob mounted at a second end for adjusting position of the upper drive roller.

13. A media feed roll apparatus according to claim 11 wherein the upper drive roller lifting tube is mounted with an exterior biasing spring which is imposed between the trunnion and a frame, said biasing spring mounted around the upper drive roller positioning shaft between the trunnion and the frame.

14. A media feed roll apparatus according to claim 12 wherein the clamp is biased by a spring mounted externally of the upper drive roller lifting tube between the clamping bracket and positioning shaft collar.

15. An upper drive roller lift assembly utilized in a media feed roll apparatus comprising:

a lift lever in communication with a first toggle arm rotatably mounted on a frame member having a travel limiter slideably positioned on a frame pin means, said toggle arm rotatably mounted to a toggle arm connector;

said toggle arm connector rotatably mounted to a second toggle arm which is rotatably mounted to the frame member;

said first and second toggle arms and toggle connector structured and dimensioned for travel in parallel planes; and said toggle arm connector being connected to a first and a second independent upper drive roller lifting tube, each lifting tube supporting a separate, independent upper drive roller for raising and lowering said rollers with pivotal movement of the lift lever.

16. The upper drive roller lift assembly according to claim 15 wherein said toggle arm connector is connected to said independent upper drive roller lifting tube via cam followers contacting a lift assembly link arm.

17. The upper drive roller lift assembly according to claim 15 wherein each of the first and second upper drive roller lifting tubes has a rotatably mounted internal shaft positioned therein, each of said shafts being in threaded communication with a trunnion at a first end of said shafts, said trunnion on each shaft being affixed to an upper drive roller assembly, each said internal shaft having a fine tuning knob mounted at a second end for adjusting the position of the upper drive roller.

18. A media feed roll apparatus for advancing articles having relatively broad surface in relation to thickness from a stack of said articles, one at a time onto a transport means, comprising:

a gating assembly with a vertically moveable gate positioned in a guide slot of a first support member, the gate moveably attached to a drive roller assembly frame by a gate arm threadably adjustable by a shaft connected to the frame;

a feed hopper in alignment with the gate and having a drive means for moving a bottom article from underneath the stack of articles through the gate;

a drive roller assembly with at least one upper drive roller mounted in a carriage, said carriage and drive roller assembly moveably attached to the frame, the frame mounted on the first support member, the carriage mounted to a pivot lift assembly, one lower roller facing each of said upper drive rollers, said lower roller being rotatably mounted on a second support member proximate to the transfer means, said upper drive rollers and said lower rollers forming an article feed nip; and the pivot lift assembly with a first toggle arm connected to a lift lever, said toggle arm being rotatably mounted on a frame member, said first toggle arm rotatably connected through a toggle arm connector to a second toggle arm rotatably mounted on said frame member, the pivot lift assembly connected to the carriage and upper drive roller assembly, said pivot lift assembly, carriage and drive roller assembly moveable from a raised drive roller position to a lowered article engagement position, said drive roller assembly releasably clampable at a raised or lowered position by a clamping means.

19. A method for causing equal feed roller pressure to be applied to articles being fed one at a time through a media feed roll apparatus, said apparatus including a drive roller assembly having independently suspended upper drive rollers, lower rollers associated in paired relationship with each of said upper drive rollers providing article feed nips therebetween, individual clamping means for holding each of said upper drive rollers in essentially stationary position relative to its paired lower rollers, each said upper drive roller being biased toward each said paired lower roller when said clamping means is unclamped, and a single lift means for raising said unclamped upper drive rollers relative to their paired lower rollers, the method comprising:

unclamping each of said individual clamping means holding said independently suspended upper drive rollers to release said upper drive rollers for movement from said essentially stationary position;

raising said upper drive rollers relative to said paired lower rollers by operation of said single lift means;

inserting an article to be fed through said apparatus in said nips between said raised upper drive rollers and said paired lower rollers;

lowering said upper drive rollers relative to said paired lower rollers by operation of said single lift means and allowing each of said upper drive rollers to be independently biased into engagement with the article inserted in said nips between said upper and lower rollers in a manner such that each of said rollers applies substantially equal force to the article; and clamping said individual clamping means to fix each of the upper drive rollers in essentially stationary position applying said substantially equal force to the article.

20. The method of claim 19 wherein, after said upper drive rollers are clamped in essentially stationary position, said pressure applied to the article is fine tuned by adjustment of threaded drive means individually associated with each of said upper drive rollers independent of the clamping means.

21. A method for causing equal feed roller pressure to be applied to articles being fed one at a time through a media feed roll apparatus, said apparatus including a drive roller assembly having independently suspended upper drive rollers, lower rollers associated in paired relationship with each of said upper drive rollers providing article feed nips therebetween, individual clamping means for holding each of said upper drive rollers in stationary position relative to its paired lower rollers, each said upper drive roller being biased toward each said paired lower roller when said clamping means is unclamped, and a single lift means for raising said unclamped upper drive rollers relative to their paired lower rollers, the method comprising:

raising said upper drive rollers relative to said paired lower rollers by operation of said single lift means;

inserting an article to be fed through said apparatus in said nips between said raised upper drive rollers and said paired lower rollers;

lowering said upper drive rollers relative to said paired lower rollers by operation of said single lift means; and unclamping each of said individual clamping means holding said independently suspended upper drive rollers to release said upper drive rollers for movement from said stationary position and to allow each of said upper drive rollers to be independently biased into engagement with the article inserted in said nips between said upper and lower rollers in a manner such that each of said rollers applies substantially equal force to the article; and clamping said individual clamping means to fix each of the upper drive rollers in stationary position applying said substantially equal force to the article.

22. The method of claim 21 wherein, after said upper drive rollers are clamped in essentially stationary position, said pressure applied to the article is fine tuned by adjustment of threaded drive means individually associated with each of said upper drive rollers independent of the clamping means.

23. A media feed roll apparatus comprising:

a drive roller assembly with at least one upper roller mounted on a frame for moveable engagement with a lift assembly, at least one lower roller mounted on said frame facing each said upper roller, said at least one upper roller and said at least one lower roller forming an article feed nip therebetween for accommodating an article positioned in said feed nip; and the lift assembly including a first toggle arm connected to a lift lever, said first toggle arm being mounted for connection through a toggle arm connector to a second toggle arm, the lift assembly being positioned relative to the at least one upper roller in a manner such that movement of said lift lever causes said at least one upper roller to move from a raised position to a lowered article engagement position to engage the article with an adjustable preset pressure, said drive roller assembly being releasably clampable at said raised or lowered position by a clamping means that is operable independent of the lift assembly to set separation of the upper and lower rollers to handle a range of article thicknesses.

* * * * *

UNITED STATES PATENT AND TRADEMARK OFFICE

CERTIFICATE OF CORRECTION

PATENT NO. : 5,203,846

DATED : April 20, 1993

INVENTOR(S) : Richard J. Kuhns and Neil A. Polit

It is certified that error appears in the above—identified patent and that said Letters Patent is hereby corrected as shown below:

Column 4, line 56, change "0" to --30--.

Column 5, line 18, change "4" to --46--.

Signed and Sealed this

Twenty-sixth Day of April, 1994

*Attest:*

Bruce Lehman

BRUCE LEHMAN

*Attesting Officer*

*Commissioner of Patents and Trademarks*